United States Patent [19]

Dankert

[11] Patent Number: 4,979,677

[45] Date of Patent: Dec. 25, 1990

[54] AUTOMATIC SPRAY GUN CLEANING APPARATUS

[75] Inventor: Manfred Dankert, Rodermark, Fed. Rep. of Germany

[73] Assignee: Illinois Tool Works, Inc., Glenview, Ill.

[21] Appl. No.: 416,058

[22] Filed: Oct. 2, 1989

[30] Foreign Application Priority Data

Oct. 11, 1988 [DE] Fed. Rep. of Germany ..... 3834616

[51] Int. Cl.[5] ..... B05B 1/28; B05B 15/02; B05B 1/06

[52] U.S. Cl. ..... 239/105; 239/112; 134/172; 137/508

[58] Field of Search ..... 239/104, 105, 106, 112, 239/291, 570, 571; 137/508; 134/172; 118/302

[56] References Cited

U.S. PATENT DOCUMENTS

| | | | |
|---|---|---|---|
| 1,954,222 | 4/1934 | Olson | 134/172 |
| 4,275,838 | 6/1981 | Fangmeyer | 239/223 |
| 4,605,168 | 8/1986 | Tachi et al. | 239/112 |
| 4,792,094 | 12/1988 | Tachi et al. | 239/106 |
| 4,830,882 | 5/1989 | Ichinose et al. | 118/302 |

*Primary Examiner*—Andres Kashnikow
*Assistant Examiner*—Karen B. Merritt
*Attorney, Agent, or Firm*—MacMillan, Sobanski & Todd

[57] ABSTRACT

Apparatus is disclosed for cleaning exposed surfaces on a nozzle and air cap assembly of an automatic paint spray gun. Solvent is delivered to a nozzle for cleaning the exposed surfaces. The nozzle is supported by a piston which is moved by the solvent flow to advance the nozzle to a cleaning position in front of the spray gun. Solvent cannot flow to the solvent nozzle until the piston moves the solvent nozzle to the cleaning position. A spring retracts the piston and the nozzle when solvent flow ceases. During cleaning, an air curtain protects the spray gun from the solvent and paint spray.

5 Claims, 2 Drawing Sheets

AUTOMATIC SPRAY GUN CLEANING APPARATUS

TECHNICAL FIELD

The invention relates to spray guns and more particularly to apparatus for cleaning exposed surfaces on a nozzle and air cap assembly on an automatic paint spray gun.

BACKGROUND ART

Most paint spray guns operate with compressed air for controlling the pattern of the atomized paint and/or for assisting paint atomization. The paint is discharged from a nozzle which is mounted adjacent to an air cap. The atomization air and/or pattern shaping air is discharged from the air cap. During spraying, there is a tendency for some paint to accumulate on the air cap and on exposed surfaces on the nozzle. Normally, such paint accumulation must be manually cleaned from the spray gun. The cleaning operation may interfere with production when an automatic spray gun on a manufacturing production line requires cleaning.

In one type of spray gun, paint is atomized by centrifugal discharge from a bell or cup which is rotated at a high speed. U.S. Pat. No. 4,275,838 discloses an automatic system for cleaning the bell. An annular shroud is mounted to normally be located behind the bell. For cleaning, a pneumatic cylinder advances the shroud to surround the bell. A single solvent nozzle is mounted in the shroud to spray solvent at the bell after the shroud is advanced. This system has the advantage of being automatic, but the disadvantage of requiring separate controls for the pneumatic cylinder and the solvent. Also, this system has not previously been adapted to an air atomization type spray guns.

DISCLOSURE OF INVENTION

According to the invention, apparatus is provided for automatically cleaning exposed surfaces on a nozzle and air cap assembly of an automatic paint spray gun of the type used on manufacturing production lines. The spray gun may be mounted, for example, on a stationary fixture, on a reciprocator which moves the spray gun along a predetermined vertical path or on an industrial robot. The spray gun may paint either stationary workpieces or workpieces as they are conveyed through a painting station.

The exposed surfaces of air cap and nozzle assembly on the spray gun are cleaned by spraying solvent or a solvent/air mixture at the surfaces. This is accomplished with a nozzle which is moved by a piston from a retracted position to a cleaning position. Preferably, the solvent nozzle is annular with a plurality of orifices which direct solvent at the surfaces to be cleaned. The piston is actuated by the flow of solvent or solvent/air to the nozzle. A valve structure inhibits solvent flow or solvent/air to the nozzle until the piston moves the nozzle to the cleaning position. When solvent flow is interrupted at the end of the cleaning operation, a spring causes the piston to move the nozzle to the retracted position. Thus, no separate pneumatic control is required for advancing the solvent nozzle to the cleaning position.

During cleaning, compressed air is preferably delivered to an annular chamber which surrounds the spray gun behind the air cap and nozzle assembly. An air curtain is discharged form this chamber in a forwardly diverging conical pattern during the cleaning cycle. As a consequence, the spray gun is protected by an air shield during cleaning which directs all solvent and paint forward of the spray gun during cleaning.

Accordingly, it is an object of the invention to provide apparatus for cleaning exposed air cap and nozzle surfaces on an automatic spray gun.

Other objects and advantages of the invention will be apparent from the following description and the accompanying drawings.

BEST MODE FOR CARRYING OUT THE INVENTION

Figure 1:
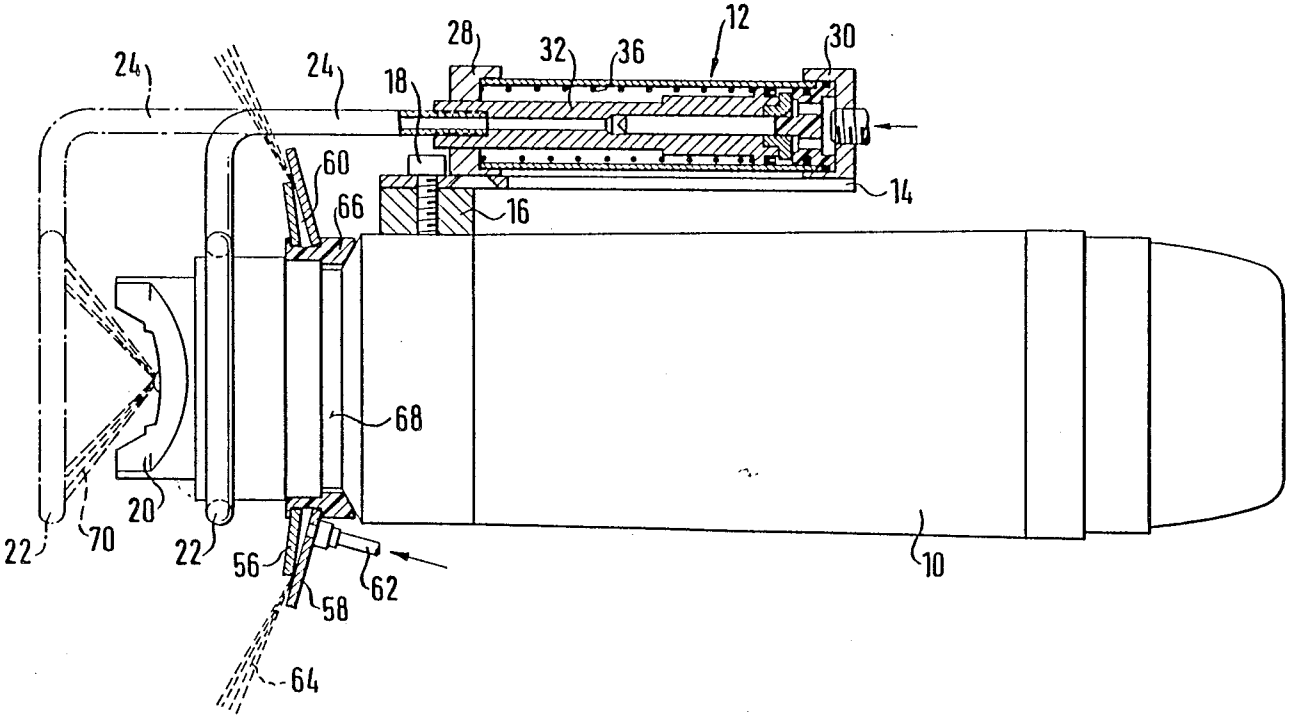
FIG. 1 is a side elevational view, in partial section, of an automatic spray gun including apparatus for cleaning exposed air cap and nozzle assembly surfaces according to the invention.

Referring to FIG. 1 of the drawings, an air atomization type automatic spray gun 10 is illustrated including apparatus 12 according to the invention for automatically cleaning paint from exposed surfaces on an air cap and fluid nozzle assembly 20 at the front of the gun 10. The apparatus 12 includes an annular nozzle 22 including a plurality of orifices arranged to spray solvent and air at the assembly 20 for cleaning its exposed surfaces. The nozzle 22 is supported by a solvent feed tube 24 and a piston 32. The piston 32 is moved in a cylindrical housing 26 to shift the nozzle 22 in a direction substantially parallel to the longitudinal axis of the spray gun 10 between a retracted position, as shown in solid lines in FIG. 1, and a cleaning position, as shown in broken lines in FIG. 1. The piston moves the nozzle 22 to the cleaning position in response to the flow of solvent and/or compressed air to the nozzle 22. When in the cleaning position, the nozzle 22 is positioned in front of the air cap and fluid nozzle assembly 20. When in the retracted position, the nozzle is located to the rear of the assembly 20 where it cannot interfere with the operation of the spray gun 10.

Figure 2:
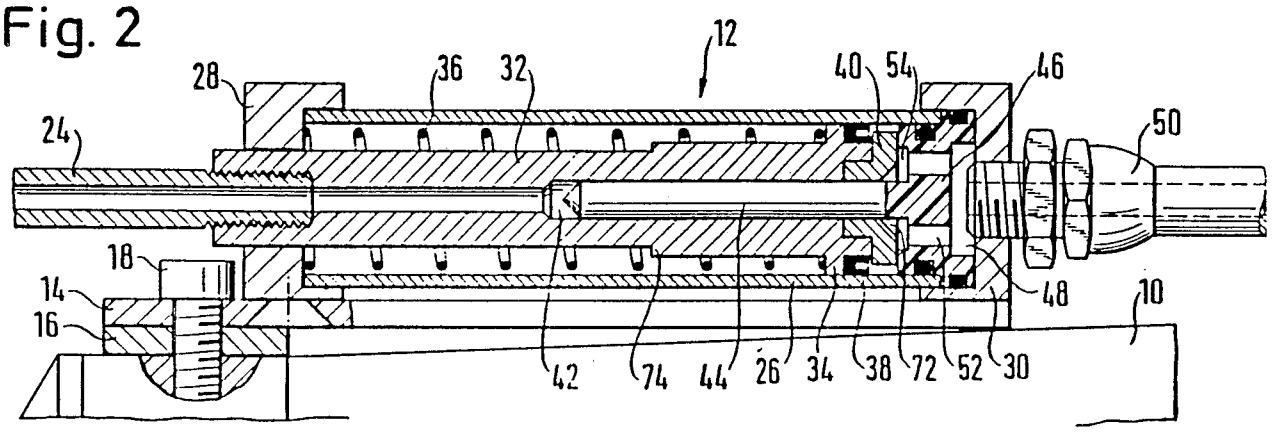
FIG. 2 is an enlarged cross sectional view through the piston assembly for advancing and retracting the solvent nozzle, with the piston shown in the retracted position.
Figure 3:
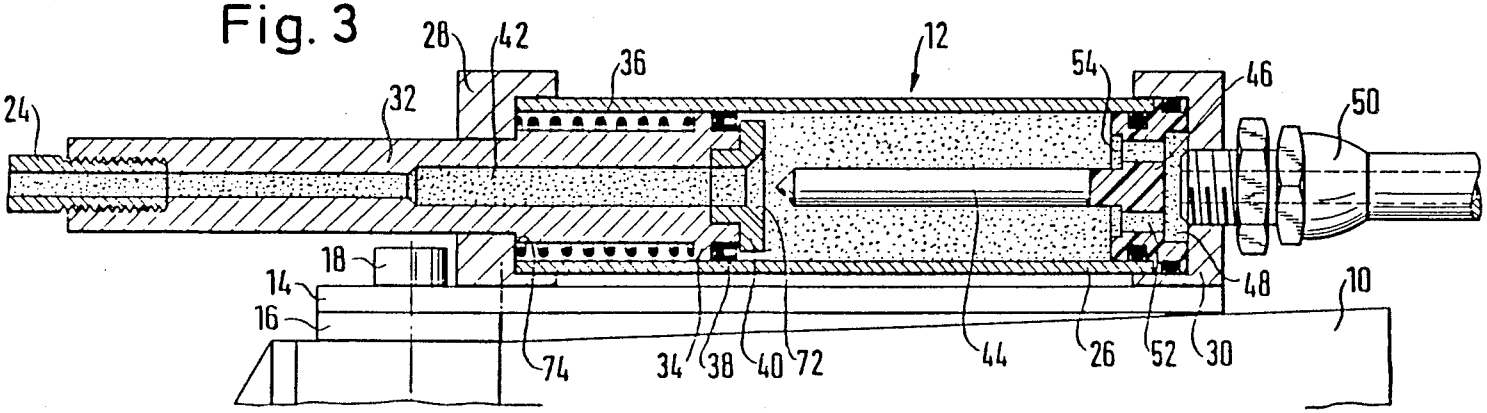
FIG. 3 is an enlarged cross sectional view through the piston assembly, similar to FIG. 2, but with the piston shown in the extended position as solvent flows to the solvent nozzle.

As shown in FIGS. 1–3, the apparatus 12 is attached to one side of the spray gun 10 by means of a support plate 14, a spacer 16 and a screw 18. A front end cover 28 and a rear end cover 30 for the cylindrical housing 26 are mounted on the plate 14. The housing 26 is attached through the plate 14, the spacer 16 and the screw 18 to the spray gun 10 with the axis of the housing 26 parallel to an axis through the air cap and fluid nozzle assembly 20. The solvent feed tube 24 is attached to the piston 32, which in turn slides in the cylindrical housing 26 and the end cover 28. As shown in FIGS. 1 and 2, a compression spring 36 biases the piston 32 to the right to normally maintain the solvent nozzle 22 in its retracted position.

The piston 32 has a head 34 which closely engages the interior walls of the housing 26. An annular packing or seal 38 having a U-shaped cross section forms a sliding fluid seal between the piston head 34 and the housing 26. At the rear end of the housing 26, a needle 44 extends from an integral head 46 coaxially into the housing 26. The needle head 46 is retained between the end cover 30 and the housing 26 to support the needle 44. The piston 32 has an axial bore 42 which telescopically slides on the needle 44 when the piston 32 slides to move the solvent nozzle 22 from the cleaning position to the retracted position. The piston bore 42 connects with the solvent feed tube 24. At its open end adjacent the head 34, a washer 40 is attached to the head 34 to surround the bore 42. When the piston 32 is in the retracted position, the washer 40 seats against the needle head 46 to form a fluid tight seal between the piston 32 and the needle 44. When the piston 32 is moved to the cleaning position, the piston 32 is clear of the needle 44 to open an inlet port 72 into the piston bore 42.

Solvent and/or air are supplied to the apparatus 12 through a conventional hose and connector 50. The hose and connector 50 communicate with a chamber 48 between the needle head 46, the end cover 30 and the housing 26. The chamber 48 in turn communicates through holes 52 through the needle head 46 with an annular expansion chamber 54 between the needle 44, the needle head 46, the housing 26 and the piston washer 40. When solvent, a solvent/air mixture or air are supplied to the chamber 48, it flows into the expansion chamber 54 and moves the piston 32 and the supported solvent nozzle 22 to the cleaning position, as shown in FIG. 3. When moved to the cleaning position, a shoulder 74 on the piston 32 abuts the front end cover 28 to prevent further movement of the piston 32. In this position, the piston 32 and attached washer 40 have moved clear of the needle 44 to open the inlet port 72 to the bore 42 and the pressurized fluid flows from the chamber 54 to the solvent nozzle 22. The fluid is discharged from the solvent nozzle 22 as a spray 70 (FIG. 1) which cleans and dries exposed surfaces on the air cap and fluid nozzle assembly 20 of the spray gun 10. When fluid pressure is removed from the chamber 54 upon completion of the cleaning cycle, the spring 36 returns the piston 32 and the attached solvent nozzle 22 to the retracted position. As the piston 32 moves back to the retracted position, solvent remaining in the chamber 54 flows back through the hose and connector 50 to the solvent supply container (not shown).

Preferably, the spray gun 10 is provided with means for forming a forwardly directed air curtain 64 around the spray gun 10. The air curtain 64 prevents solvent and paint from depositing on the spray gun and from entering the environment behind the spray gun during the cleaning cycle. A support 66 is mounted in an annular groove 68 on the spray gun 10 behind the air cap and nozzle assembly 20. A front conical disk 56 and a rear conical disk 58 are mounted in the support 66. The front conical disk 56 faces to the rear of the spray gun 10 and the rear conical disk 58, which is of a larger outer diameter than the front disk 56, faces to the front of the spray gun 10. The disks 56 and 58 form a wedge shaped chamber 60 which is open at its periphery. A compressed air line 62 is connected to the chamber 60. Compressed air flows from the chamber 60 in an outward and forward, generally conical direction to form the curtain 64 which shields the spray gun 10 from deposits of paint and solvent during the cleaning operation. The air curtain 64 also can help during cleaning by directing the solvent and paint into a spray booth for protecting the environment.

It will be appreciated that various modifications and changes may be made in the above described embodiment of apparatus for cleaning exposed surfaces on a nozzle and air cap assembly of an automatic paint spray gun without departing from the spirit and the scope of the following claims.

I claim:

1. Apparatus for cleaning exposed surfaces on a nozzle and air cap assembly of an automatic paint spray gun comprising a solvent nozzle, means for delivering solvent under pressure to said solvent nozzle, means responsive to the delivery of pressurized solvent for moving said solvent nozzle from a retracted position to a cleaning position wherein said solvent nozzle directs a flow of such delivered solvent at the exposed surfaces, said means for moving said solvent nozzle including a housing, a piston and means supporting said solvent nozzle from said piston, said piston sliding in said housing to move said solvent nozzle between said retracted and cleaning positions, spring means urging said piston and said solvent nozzle towards said retracted position, said piston and said housing forming an expansion chamber, wherein delivered solvent flows into said expansion chamber to move said piston and said solvent nozzle to said cleaning position, and means for preventing delivery of solvent to said solvent nozzle until said solvent nozzle is moved to said cleaning position.

2. Apparatus for cleaning exposed surfaces on a nozzle and air cap assembly of an automatic paint spray gun, as set forth in claim 1, wherein said solvent delivery preventing means includes a needle mounted in said expansion chamber in said housing to extend coaxial with the direction of movement of said piston, said piston having a bore which receives said needle when said piston and said solvent nozzle are in said retracted position, said bore communicating with said solvent nozzle, and wherein said piston is axially spaced from said needle when said piston and said solvent nozzle are in said cleaning position.

3. Apparatus for cleaning exposed surfaces on a nozzle and air cap assembly of an automatic paint spray gun comprising a solvent nozzle, means for delivering solvent under pressure to said solvent nozzle, means responsive to the delivery of pressurized solvent for moving said solvent nozzle from a retracted position to a cleaning position wherein said solvent nozzle directs a flow of such delivered solvent at the exposed surfaces, and means for preventing delivery of solvent to said solvent nozzle until said solvent nozzle is moved to said cleaning position.

4. Apparatus for cleaning exposed surfaces on a nozzle and air cap assembly of an automatic paint spray gun, as set forth in claim 3, and further including means for establishing an air curtain around said spray gun for preventing the deposit of solvent and paint on said spray gun during cleaning.

5. Apparatus for cleaning exposed surfaces on a nozzle and air cap assembly of an automatic paint spray gun comprising a solvent nozzle, means for delivering solvent under pressure to said solvent nozzle, means responsive to the delivery of pressurized solvent for moving said solvent nozzle from a retracted position to a cleaning position wherein said solvent nozzle directs a flow of such delivered solvent at the exposed surfaces, and means for establishing an air curtain around said spray gun for preventing the deposit of solvent and paint on said spray gun during cleaning.

* * * * *

UNITED STATES PATENT AND TRADEMARK OFFICE

CERTIFICATE OF CORRECTION

PATENT NO. : 4,979,677

DATED : December 25, 1990

INVENTOR(S) : Manfred Dankert

It is certified that error appears in the above-identified patent and that said Letters Patent is hereby corrected as shown below:

On the title page Item (73) change the assignee from "Illinois Tool Works, Inc., Glenview, Illinois" to read -- DeVilbiss GmbH, Dietzenbach, West Germany --.

Signed and Sealed this

Twenty-fourth Day of November, 1992

*Attest:*

DOUGLAS B. COMER

*Attesting Officer*

*Acting Commissioner of Patents and Trademarks*